US008747287B2

(12) United States Patent
Li

(10) Patent No.: US 8,747,287 B2
(45) Date of Patent: Jun. 10, 2014

(54) BACK-EXTENSION CHAIR FOR THE PREVENTION OF LOW BACK PAIN SYMPTOMS

(71) Applicant: Yu Li, Johns Creek, GA (US)

(72) Inventor: Yu Li, Johns Creek, GA (US)

( * ) Notice: Subject to any disclaimer, the term of this patent is extended or adjusted under 35 U.S.C. 154(b) by 0 days.

(21) Appl. No.: 13/647,360

(22) Filed: Oct. 8, 2012

(65) Prior Publication Data

US 2013/0072360 A1 Mar. 21, 2013

Related U.S. Application Data

(63) Continuation-in-part of application No. 12/951,065, filed on Nov. 21, 2010, now abandoned.

(51) Int. Cl.
*A63B 21/00* (2006.01)

(52) U.S. Cl.
USPC ..... 482/130; 482/142; 482/121; 482/907; 482/140

(58) Field of Classification Search
USPC ..... 482/130, 142, 121, 907, 140
See application file for complete search history.

(56) References Cited

U.S. PATENT DOCUMENTS

| | | | | | |
|---|---|---|---|---|---|
| 1,973,945 | A * | 9/1934 | Chavin et al. | ..... | 482/130 |
| 3,767,190 | A * | 10/1973 | Biggerstaff | ..... | 482/142 |
| 5,599,261 | A * | 2/1997 | Easley et al. | ..... | 482/130 |
| 5,624,361 | A * | 4/1997 | Lai | ..... | 482/130 |
| 6,152,866 | A * | 11/2000 | Kuo | ..... | 482/142 |
| 6,752,745 | B1 * | 6/2004 | Davis | ..... | 482/72 |
| 2008/0076649 | A1 * | 3/2008 | Chen | ..... | 482/140 |
| 2008/0090709 | A1 * | 4/2008 | Chen | ..... | 482/140 |

* cited by examiner

*Primary Examiner* — Jerome W Donnelly

(57) ABSTRACT

A chair-like exercising apparatus comprises a back, a seat, front legs, rear legs, and resistance element(s) which provide a broad range of resistance force adjustable by the user for the back extension exercise. The chair back pivotally connects to the rear legs directly, and pivotally connects to the front legs or rear legs through the resistance element(s). The resistance element comprises a compress-coil-spring cylinders (or constant-force-spring devices) and the cylinder holders (or the device holders). The resistance level of the back extension exercise is adjusted by switching the interchangeable compress-coil-spring cylinders (or constant-force-spring devices) of appropriate loads inside the cylinder holders (or device holders). A user sits on the chair and sway backward to perform back extension exercise after selecting an appropriate resistance level based on his/her physical condition. The apparatus is simple, affordable and can be used as a regular chair in its locked position. A regular back extension exercise with proper resistance force strengthens the low back muscles (erector spinae), improves and prevents the low back pain symptoms.

17 Claims, 8 Drawing Sheets

(A)

(B)

(C)

BACK-EXTENSION CHAIR FOR THE PREVENTION OF LOW BACK PAIN SYMPTOMS

CROSS-REFERENCE TO RELATED APPLICATIONS

This application is a continuation-in-part of application Ser. No. 12/951,065, filed on Nov. 21, 2010 by present investor

BACKGROUND

1. Field of Invention

This invention relates to a back-extension exercising apparatus, specifically to such an apparatus which provides a broad range of resistance force adjustable by the user for back extension exercise in a portable and affordable chair format.

2. Prior Art

Low back pain is a pervasive symptom in the human population. In the U.S., a NIH study published in 1998 estimates that about one-half of adults have low back pain in any given year, and more than 26 million Americans ages 20 to 64 and almost 6 million ages 65 and older have frequent low back pain (http://www.co-cure.org/CRISP/fmsprev.htm). A literature review of multiple studies of low back pain in adults estimated that the prevalence rate among the population of North American adults is 5.6% (Loney PL and Stratford PW 1999. The Prevalence of Low Back Pain in Adults: A Methodological Review of the Literature. PHYS THER. 1999; 79:384-396); applying this estimate in today's population, approximately 18 million people are experiencing low back pain on any given day.

Most acute back pain is mechanical in nature; for example, in strained muscles; chronic low back pain is hard to diagnose and is one of the most difficult and costly medical problems in the world. The most effective way for speedy recovery from lower back pain and prevention from recurrence of the injury is exercise ("Low Back Pain Fact Sheet", NIH Publication No. 03-5161, 2003). Studies show that strengthening exercises of low back muscles significantly improve chronic lower back pain symptoms; this improvement is long-lasting and reduces the cost for health care comparing to other more passive treatments (Carpenter, David M and Nelson, Brian W, 1999, Low back strengthening for the prevention and treatment of low back pain. Med. Sci. Sports Exerc., Vol. 31, No. 1, pp. 18-24).

The major low back muscle is erector spinae, a group of muscles and tendons that run along the lateral grooves of the vertebral column and are responsible for keeping the body in an erect position. The unique position of erector spinae makes it difficult to exercise without the assistance of special equipment. An effective strengthening exercise for the low back muscles (erector spinae) is to use a specialized back-extension apparatus. A user has his/her pelvis stabilized to the seat and pushes backwards against resistance force. Currently, those types of specialized apparatuses for the back-extension exercise are mainly available in fitness centers, which use metal blocks to produce the resistance force for the exercise. Those apparatuses are bulky, heavy and expensive. Most people, especially the ones with the most need for low back muscles exercises have limited access to this specialized apparatus.

There are a number of prior arts that described of exercising apparatus using coil springs (for example U.S. Pat. Nos. 7,381,171 and 5,110,121), however the prior arts did not provide sufficient resistance force or a selection of proper resistance force for an effective back extension exercises. In order to improve and prevent low back pain symptoms, back extension exercises using sufficient and proper level of resistance force are needed to strength the erector spinae. The proper level of resistance force for back extension exercise can vary considerably due to user's age and physical conditions. Even for same user, the resistance force used for effective exercise may increase after physical condition improves following regular exercise.

This continuation-in-part application made following improvements: the machine now uses interchangeable coil-spring cylinders as parts of resistance elements to simplify the resistance level adjustment and operation; uses constant force spring devices as alternatives within resistance elements to provide stable resistance force; adds an embodiment that use one resistance element.

SUMMARY OF THE INVENTION

The present invention provides an affordable, specialized apparatus for back extension exercises. In a preferred embodiment, the apparatus has a chair-like structure with a seat, front legs and rear legs, and a back. The bottom of the back pivotally connects to the rear legs, and the middle of the back connects to the front legs or rear legs through resistance element(s). The resistance element comprises compress coil-spring cylinders (or constant-force-spring device) and the cylinder holders (or the device holders). The compress coil-spring cylinders (or the constant-force-spring devices) comprise a series of coil-spring cylinders (or constant-force-spring devices) of same size but a broad range of preset loads for resistance level adjustment.

A user sits on the chair and sways backwards to perform the back extension exercise using a proper level of resistance force. The resistance force is selected by using coil-spring cylinders (or constant-force-spring devices) of appropriate load based on his/her own physical condition to achieve an effective and useful exercises. A regular back extension exercise using a proper level of resistance force strengthens the low back muscles (erector spinae), and improves and prevents the low back pain symptoms. The apparatus is user-friendly and can be converted into a regular chair with a simple switch or lock.

DRAWINGS—Figures

Figure 1:
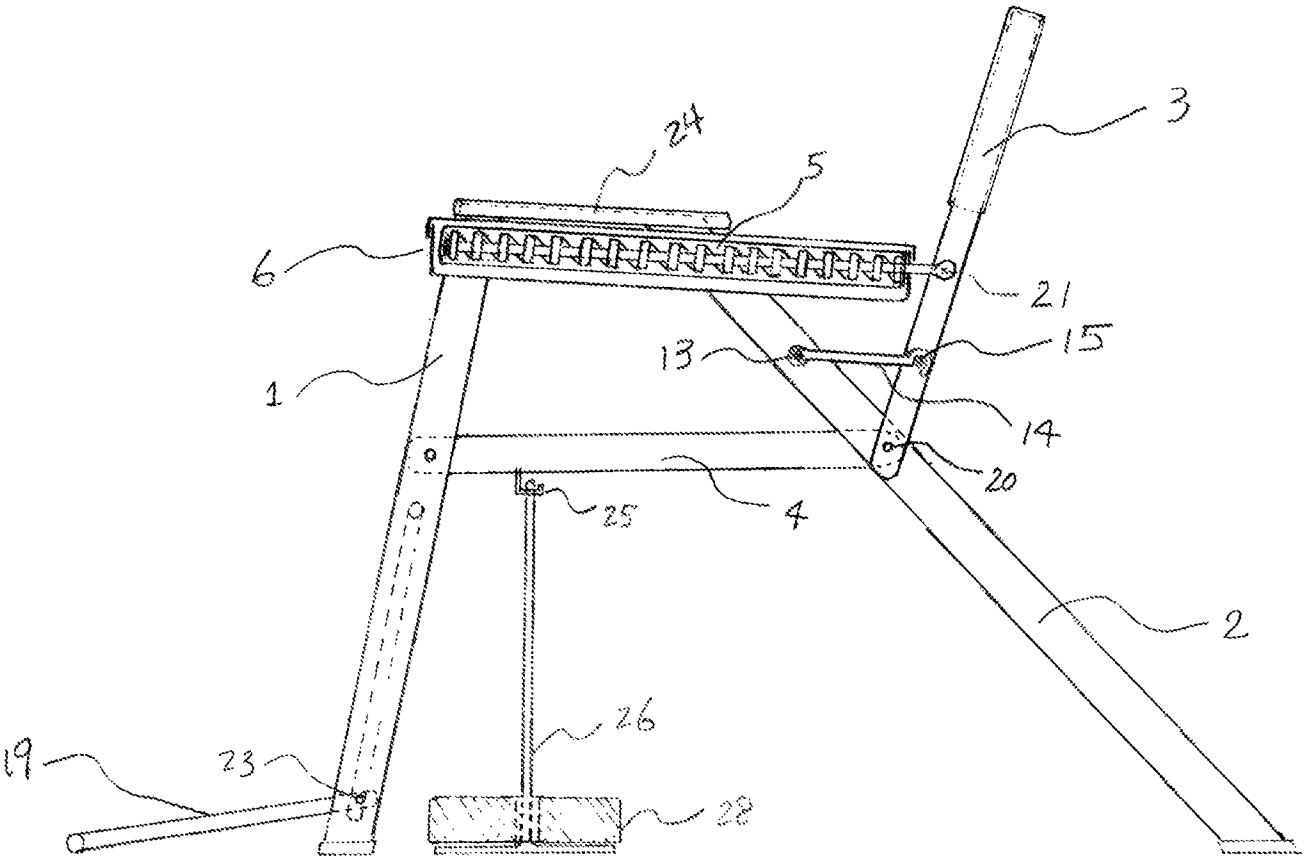
FIG. 1 is a side view of the present invention with chair back in an upright (or fixed) position.
Figure 6:
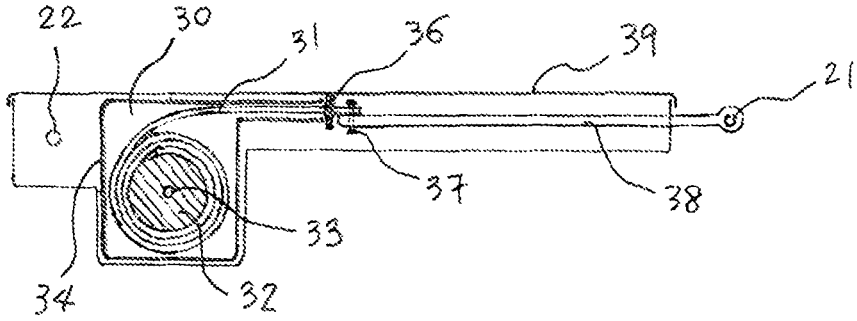
Figure 6:
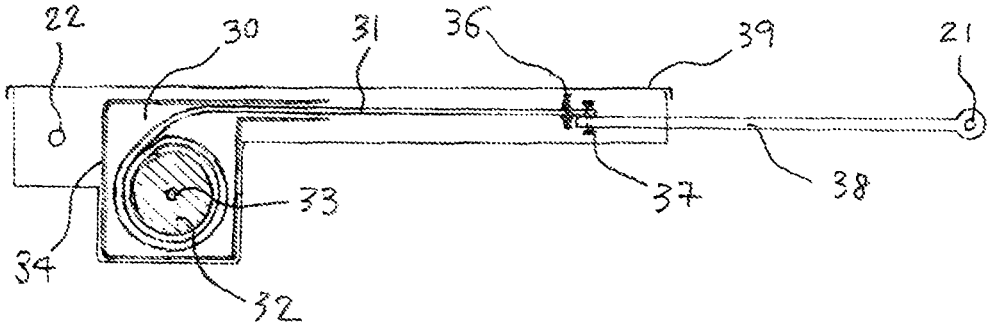
Figure 6:
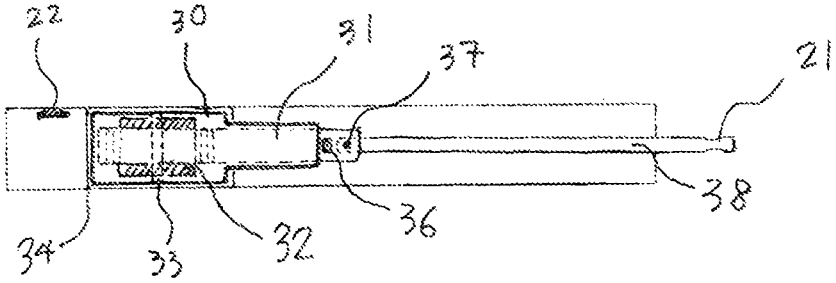

FIG. 6(A) is a detailed side view of the constant-force-spring device and the device holder in which the device is in the position without outside load and the chair's back is in an upright (fixed) position, as of FIG. 1; (B) is a detailed side view of the constant-force-spring device and the device holder in which the device is in a loaded position and the chair back is in a backward extended position, as of FIG. 2. (C) is a detailed top view of the constant-force-spring device and the device holder of FIG. 6(A).

Figure 7:
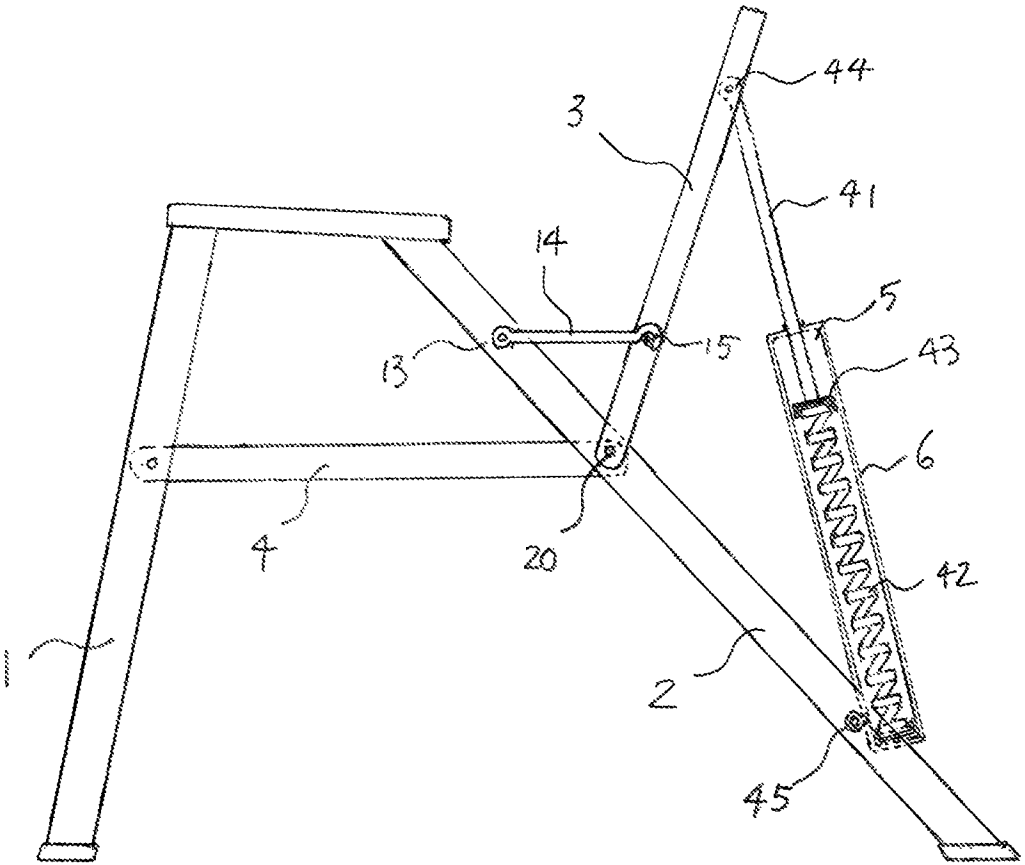

FIG. 7 is a side view of the present invention in an alternative design that the resistance element mounted on the back of the chair.

Figure 8:
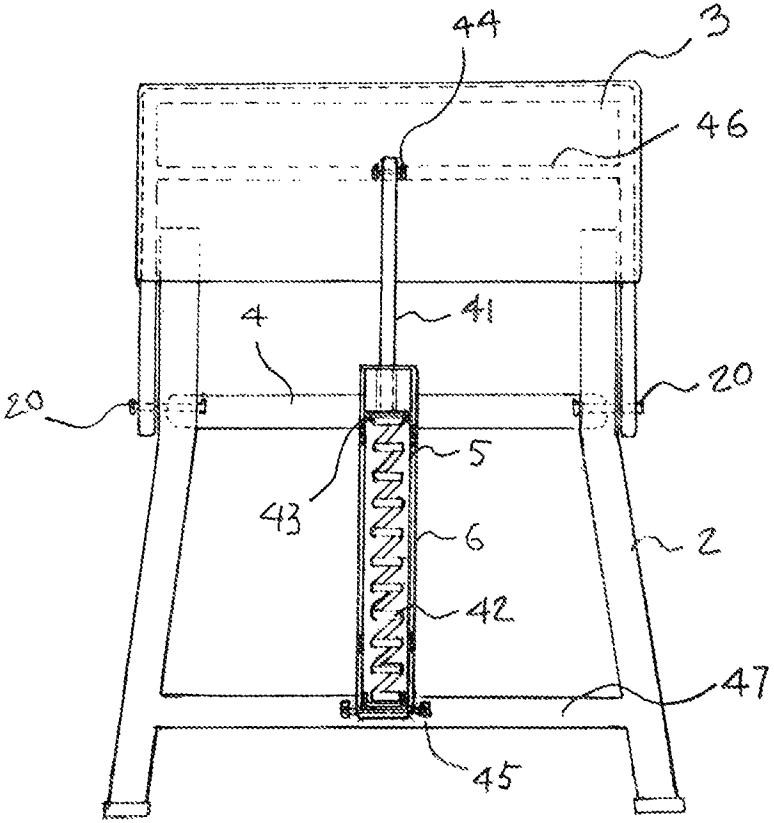

FIG. 8 is a back view of the present invention in an alternative design that the resistance element mounted on the back of the chair.

THE PREFERRED EMBODIMENT

Figure 2:
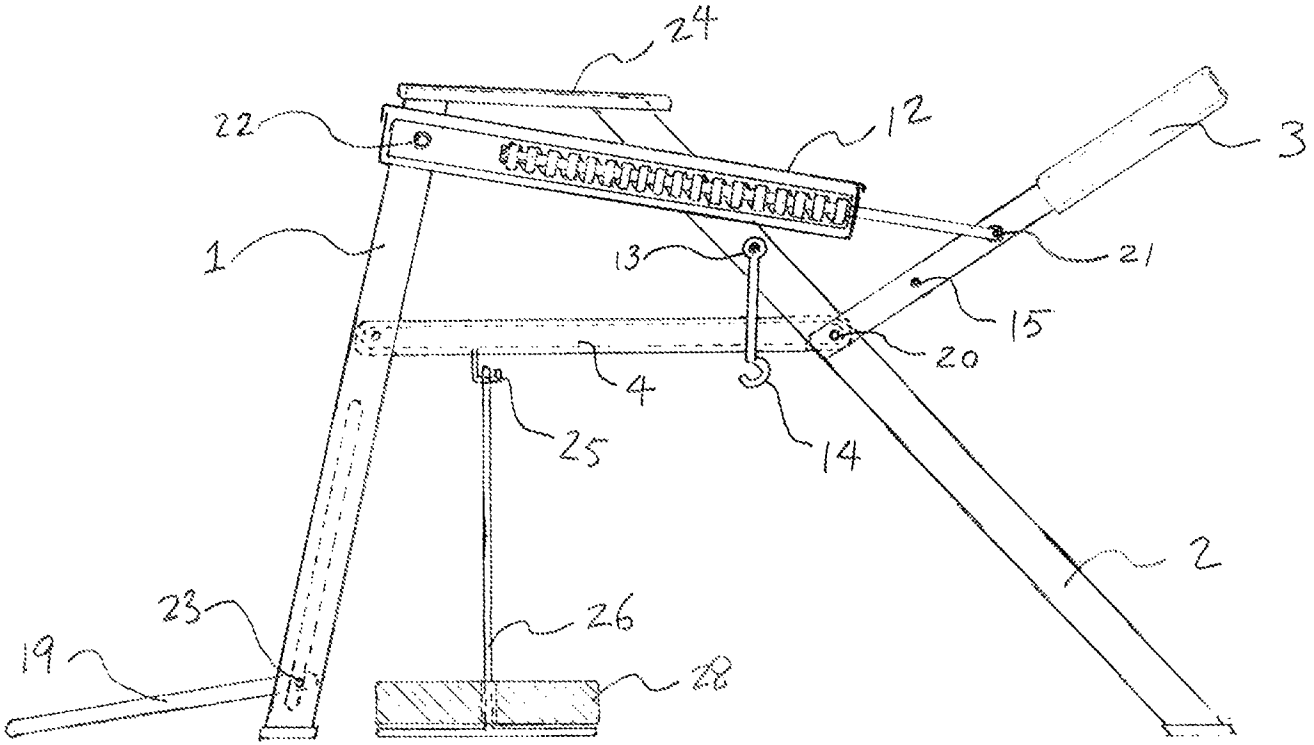
FIG. 2 is a side view of the present invention with the chair back in a backward, extended position.
Figure 3:
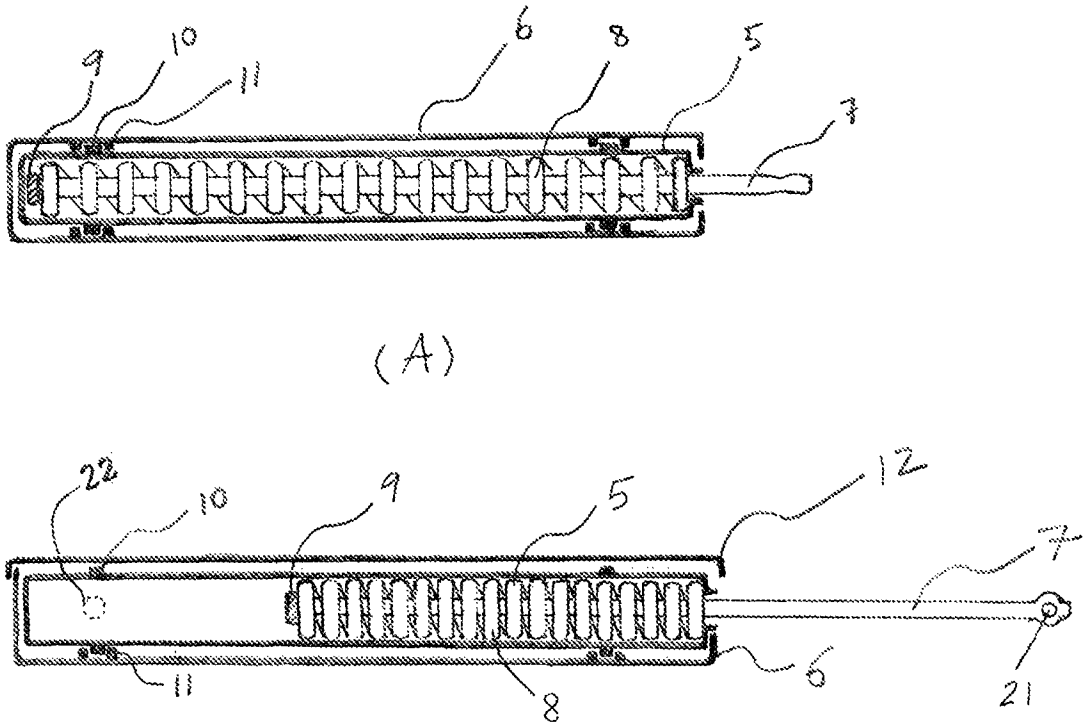
FIG. 3(A) is a detailed top view of the coil-spring cylinder and the cylinder holder in which the coil-spring cylinder is in a no-load position, as of FIG. 1; (B) is a detailed side view of the coil-spring cylinder and the cylinder holder in which the coil-spring cylinder is in a loaded position, as of FIG. 2.
Figure 4:
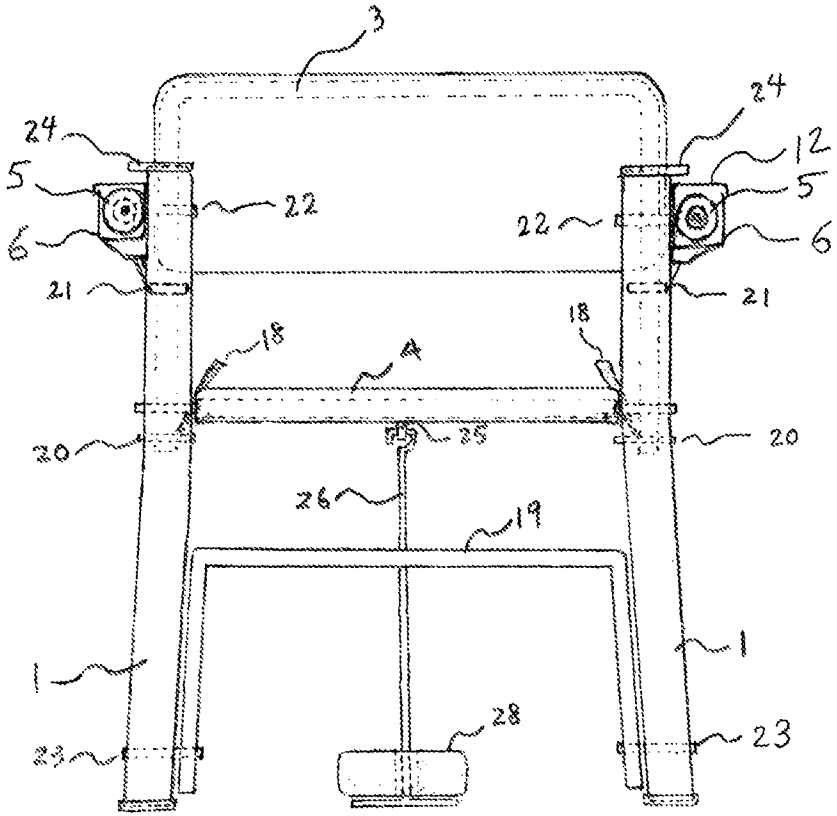
FIG. 4 is a front view of the present invention.

One embodiment of the back-extension apparatus is a chair like device as illustrated in FIG. 1, FIG. 2 and FIG. 4. The chair has two front legs (1), two rear legs (2), a back (3), a seat (4) and two identical resistance elements located beside armrests (24) at each side of the chair. The resistance element comprises a coil-spring cylinder (5) and a cylinder holder (6) (FIG. 3). The chair back (3) is pivotally connected to the rear legs (2) at hinge (20) with bolts. The rods (7) of the coil-spring cylinders (5) connect to the back (3) at the hinge (21) with bolts. The cylinder holder (6) pivotally connects to the front legs (1) at the hinge (22) with bolts (FIG. 2).

The coil-spring cylinder (5) comprises a compress coil spring (8), a rod (7), and a rod cap (9). The open end of the rod connect to the back (3), a backward movement of the back (3) pull the rod (7) out of the cylinder (5) and compress the coil spring (8) through the rod cap (9). There are two raised rings (10) on the outside of cylinder (5), the rings (10) match to the recessed ring channels (11) of the cylinder holder (6). The installations and exchanges of different load level coil-spring cylinders (5) are done by sliding the cylinder (5) into the cylinder holder (6); the cylinder (5) is hold in a fixed position by the cylinder holder (6). The resistance level (load) of the coil spring cylinders (5) is calculated when the coil spring (8) is compressed at the solid height. The resistance load varies for a compress coil spring depended on the compressed level of the coil spring.

Figure 5:
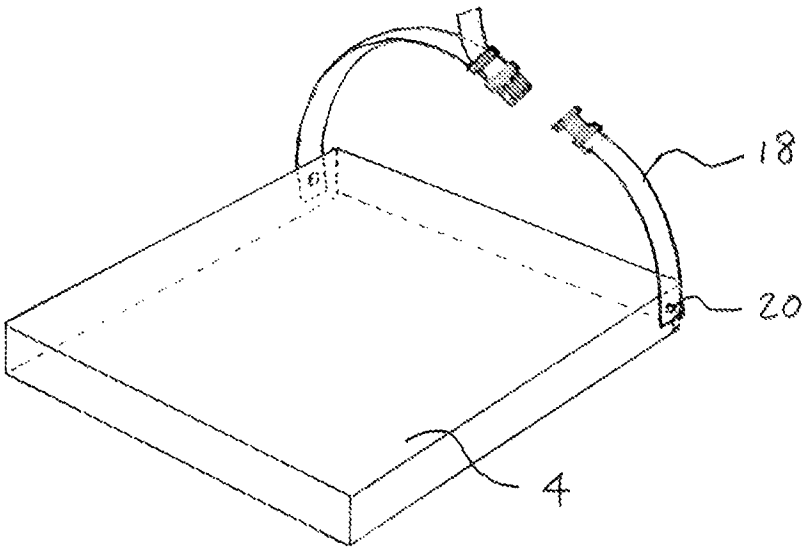
FIG. 5 is a detailed view of the seat fastener.

The chair has an adjustable buckle fastener (18) (FIG. 5) attached to hinge (20). The fastener (18) is used to stabilize pelvis position during exercise. A U-shaped feet-rest (19) is connected to the front legs (1) at hinge (23) (FIG. 1). The feet-rest (19) has a storage position (FIG. 4) and a forward position (FIG. 1). The forward position of the feet-rest is needed to improve the balance of the chair when the chair is used for back extension exercise. The legs of the chair were slightly bended outward (FIG. 4) to increase the stability of the chair. A metal hook (25) is attached to the enhanced metal frame bar under the seat. A removable hanging rod (26) with flat metal base is hanged on the hook, and heavy weight plates (28) can be added to the flat base. The extra weight adds balance to the chair when a user uses a high level of resistance force for the back extension exercise.

In operation, a user sits on the chair and uses his/her back pushing the back (3) to complete a set of back and forth movement. The back-extension exercise requires a proper level of resistance force for the user to achieve benefits of effective low back muscles exercise. A proper resistance level for the back-extension exercise varies for each user depending on user's physical condition. A user can select a suitable resistance level for the back extension exercise by selecting and switching the cylinders with appropriate loads.

As shown in FIG. 1, the apparatus can be used as a regular chair after the back (3) is locked at the upright position by element (14) connecting stubs (13) and (15). The coil-spring cylinders are exchanged inside of the cylinder holder when the back (3) is at the upright position. In the general population, the proper level of resistance for the back-extension exercise is normally in the range of 10 pound to 160 pound. A series of coil-spring cylinders with load level from 5 pound to 80 pound are pre-made to simplify the adjustment and switching of resistance force levels.

In accordance to another embodiment (FIGS. 6(A), (C)) of the resistance element, the resistance element comprises a constant force spring device and a device holder (35). The constant force spring device is a closed unit with an enclosure (34); inside the enclosure, a pre-stressed spring strip (31) wraps on a drum (32), the open end of the spring strip (31) is extended at initial deflection distance with a stopper (36) at the enclosure opening. A further deflection (extension) of spring strip (31) yield full rated load. The spring strip (31) connects to a rod (38) with a pin (37). The "T" shape device holder (35) has a lid (39) and is made to hold constant force spring device in a fixed position.

Similar to that of coil-spring cylinder (FIG. 3), the constant force spring device holder (35) and the rod (38) connect to the front leg (1) and the back (3) at the hinges of 22 and 21 (FIG. 2). A backward sway of the back (3) pulls the spring strip (31) into an extended position from the enclosure (34) through the rod (38) (FIG. 6(B)); the drum (32) rotates freely along an axis (33) which has fixed supports (not shown) on the inside wall of the enclosure (34) (FIGS. 4(B) (C)). The resistance level of the constant force spring device is maintained in a constant rated load in the process. The load of the constant force spring is determined by the thickness and width of the spring strip (31) and the diameter of the drum (32). A series of constant-force-spring device with load level from 5 pound to 80 pound are pre-made to simplify the adjustment and selection of proper resistance levels.

In another embodiment of present invention, the resistance element is installed behind the chair back (FIGS. 6, 7), and only one resistance element is used for the back-extension exercise. The coil-spring cylinder used in FIG. 6 has differences comparing to that in FIG. 3. A rod (41) is in the front of compress coil spring (42), the rod (41) use a cap (43) compressing the coil spring (42) as the back (3) sways backward. The rod (41) and the cylinder holder (6) pivotally connect to the chair back and rear legs at the hinges (44, 45) of frame bar (46) and (47) respectively.

Advantages

From the description above, some embodiments of the back-extension apparatus have a number of advantages:

(a) The present invention uses coil-spring cylinders or constant-force-spring devices to produce the resistance force for the back extension exercise, which reduces the equipment's size, weight and cost.

(b) The present invention is in a chair format with dual usage, and suitable for home-like surroundings, which make it possible for more people access to this specialized exercising equipment and use it regularly for the back extension exercise.

(c) The present invention allows users to adjust the resistance force level for the back extension exercise at a proper resistance level, which is critical to achieve a useful and effective exercise of low back muscles (erector spinae).

Conclusion and Scope

The present invention is a simple, affordable exercising apparatus which make it possible for more people to access this specialized equipment for the back extension exercise. This exercise has been demonstrated to be effective in improving and preventing the chronic low back pain symptom. A wide availability of preset invention could be an important solution to prevent the chronic low back pain symptoms and reduce the low back pain related medical costs.

The above embodiments are only used to illustrate the present invention, and not intended to limit the scope thereof.

For example, the apparatus and the resistance element can be modified and constructed in a different styles or formats. Thus the scope of the embodiments should be determined by the appended claims and their equivalents, rather than by the sample given.

What is claimed is:

1. A device comprising a seat with two front legs, two rear legs, and a back, wherein; said back is pivotally connected to said rear legs, and pivotally connected to said front legs by elements that produce predetermined resistance force when said elements are extended or compressed, whereby said device providing proper levels of resistance for an effective back extension exercise.

2. The element of claim 1 wherein comprises a coil-spring cylinder with a piston rod, and a cylinder-holder; said cylinder-holders pivotally attach to the front legs and said rods pivotally attach to said back.

3. The coil-spring cylinder and the cylinder-holder of claim 2, wherein have an interlocking mechanism to lock the coil-spring cylinder inside the cylinder-holder.

4. The coil-spring cylinder of claim 2, wherein comprises a coil spring over said piston rod, and said coil spring is compressed by said piston rod when said back sways backward.

5. The elements of claim 2, wherein comprise a series of interchangeable cylinders which hold coil springs with predetermined resistance loads in a broad range.

6. The predetermined resistance force of claim 1 wherein is the resistance load of a coil-spring cylinder measured as said coil spring fully compressed, and said resistant force is adjusted by exchanging said cylinders with different resistance load.

7. The element of claim 1 wherein comprises a constant-force devices and a constant-force device holders, said constant-force devices pivotally attaches to said back through rods and said device holders pivotally attaches to said front legs.

8. The constant-force device and the device holder of claim 7, wherein have an interlocking mechanism to lock the constant-force device inside of the device holder.

9. The constant-force devices of claim 7, wherein comprises a set of constant force springs mounted on drums arranged in tandem orders inside of said constant-force device; and free ends of said constant force springs connect to said rod.

10. The constant-force devices of claim 7, wherein comprise a series of said constant-force devices that contain an varying quantities and types of said constant force springs for providing predetermined resistant load in a broad range.

11. The predetermined resistance force of claim 1 wherein is the load of said constant force springs measured when said constant force springs are pulled in extended position by said rod, and is adjusted by exchanging said devices with different levels of predetermined resistant loads.

12. A device comprising a seat with two front legs, two rear legs, and a back, wherein; said back is pivotally connected to said rear legs both directly and by elements that produce predetermined resistance force when said elements are extended or compressed.

13. The element of claim 12 wherein comprises a coil-spring cylinder and a cylinder-holder; said cylinder-holder pivotally attaches to the rear legs and said cylinder pivotally attaches to said back through a piston rod.

14. The coil-spring cylinder and said cylinder holder of claim 13, wherein have an interlocking mechanism to lock said cylinder inside of said cylinder holder.

15. The coil-spring cylinder of claim 13, wherein contains a coil spring under said piston rod, and said coil spring is compressed by said piston rod following a backward swaying of the back.

16. The coil-spring cylinder of claim 13, wherein comprises a series of interchangeable cylinders that contain coil springs with different levels of predetermined resistant loads at fully compressed height.

17. The predetermined resistance force of claim 12 wherein is the resistant load of the coil-spring cylinder used in the device and is adjusted by exchanging said cylinders with different levels of predetermined resistant loads.

* * * * *